US005166466A

United States Patent [19]

Yamauchi

[11] Patent Number: 5,166,466

[45] Date of Patent: Nov. 24, 1992

[54] MUSICAL TONE CONTROL INFORMATION INPUT MANIPULATOR FOR ELECTRONIC MUSICAL INSTRUMENT

[75] Inventor: Akira Yamauchi, Hamamatsu, Japan

[73] Assignee: Yamaha Corporation, Hamamatsu, Japan

[21] Appl. No.: 706,591

[22] Filed: May 28, 1991

[30] Foreign Application Priority Data

May 30, 1990 [JP] Japan ..... 2-140262

[51] Int. Cl.[5] ..... G10H 1/34; H01C 10/10

[52] U.S. Cl. ..... 84/690; 84/718; 338/69

[58] Field of Search ..... 84/600, 644, 670, 678–690, 84/692–711, 718–721, 743–746; 338/69

[56] References Cited

U.S. PATENT DOCUMENTS

| | | | |
|---|---|---|---|
| 3,681,507 | 8/1972 | Slaats et al. | 84/718 X |
| 4,646,609 | 3/1987 | Teruo et al. | 84/615 |
| 4,915,002 | 4/1990 | Dornes | 84/692 |
| 5,027,688 | 7/1991 | Suzuki et al. | 84/600 |

FOREIGN PATENT DOCUMENTS

| | | |
|---|---|---|
| 0248527 | 12/1987 | European Pat. Off. . |
| 52-117120 | 10/1977 | Japan . |
| 194998 | 6/1989 | Japan . |
| 2-25194 | 5/1990 | Japan . |
| 2-113976 | 9/1990 | Japan . |

*Primary Examiner*—Stanley J. Witkowski
*Attorney, Agent, or Firm*—Graham & James

[57] ABSTRACT

A musical tone control information input manipulator comprises a manipulator body, a slide manipulator, and a pressure sensor. One end of the manipulator body is supported so as to be pivotally turnable and the other end thereof is supported by an elastic spring. The slide manipulator is provided on the manipulator body to generate a position signal representing a slide position on the manipulator body. Force acting on the elastic spring is detected by the pressure sensor to generate a pressure signal. The position signal and the pressure signal are respectively used as a bow position signal and a bow pressure signal for a rubbed string instrument such as a violin to generate a musical tone of the rubbed string instrument from an electronic musical instrument.

13 Claims, 5 Drawing Sheets

MUSICAL TONE CONTROL INFORMATION INPUT MANIPULATOR FOR ELECTRONIC MUSICAL INSTRUMENT

BACKGROUND OF THE INVENTION

1. Field of the Invention

The present invention relates to an electronic musical instrument and particularly to a musical tone control information input manipulator for an electronic musical instrument.

2. Description of the Related Art

The present applicant has proposed a sound source using a nonlinear musical tone synthesizing method for generating musical tones of a string instrument or a wind instrument. For example, this is utilized as a rubbed string instrument model in which a nonlinear output is generated by inputting bow pressure and bow velocity, and a pitch is decided by inputting a delay length.

As means for generating the information for bow pressure and bow velocity, there have been proposed an performance manipulator for inputting bow velocity and bow pressure completely independently, for example one in which bow pressure is given by pressure applied to the manipulator and bow velocity is given by the position or displacement velocity of the manipulator, and a performance manipulator constituted solely by a keyboard for inputting bow velocity and bow pressure, for example one in which priority is given to one of the bow pressure and bow velocity and calculation is done on the basis of a correlation function. In performance of a natural rubbed string instrument, a musical tone is generated by rubbing a string with a bow, where the influence of the bow on the string changes delicately according to the position (a bow head, a bow middle, a bow base, etc.) of the bow rubbing the string. Accordingly, the aforementioned conventional technique has a limit in natural expression of genuine bowing.

SUMMARY OF THE INVENTION

An object of the present invention is to provide a musical tone control information input manipulator for an electronic musical instrument in which performance information can be inputted with the feeling of bowing in a natural rubbed string instrument.

Another object of this invention is to provide a musical tone control information input manipulator for an electronic musical instrument in which bow pressure information and bow velocity information can be inputted with the feeling of bowing in a natural rubbed string instrument.

According to an aspect of the present invention, the performance manipulator is constituted by utilizing the principle of the "lever".

The musical tone control information input manipulator for an electronic musical instrument has a supporting member, a manipulator body attached to the supporting member so as to be turnable with respect to the supporting member, a restoring member for generating force to drive the manipulator body to a predetermined stable position, a slide manipulator attached onto the manipulator body so as to be slidable, and a pressure sensor for detecting pressure given by a performer through the slide manipulator.

In bowing in a natural rubbed string instrument, the hair of a bow is put on a string while an end portion of the bow is held by the hand more skillful than the other. Here, it is considered that a fulcrum and a force point are present in the hand holding the bow and that an action point is present in the portion touching the string.

The problem to be mentioned herein is that the tone color changes as the distance between the force point in an end portion of the bow and the action point as a contact point between the string and the bow changes. If bow pressure information is generated regardless of the bow position such as a bow base, a bow middle and a bow head, it becomes very difficult to express genuine bowing.

As described above, the input manipulator according to the present invention is constituted by: attaching a manipulator body so as to be turnable by utilizing the principle of the lever; attaching a slide manipulator onto the manipulator body so as to be slidable; and attaching a sensor with a restoring member to the manipulator body to detect the rotational position of the manipulator. Generation of performance information with the feeling of bowing in a natural musical instrument is made possible by detecting force given by a performer through the slide manipulator as bow pressure through detecting the rotational position of the manipulator.

When, for example, a slide manipulator is provided on a manipulator body having one end serving as a rotatable fulcrum and the other end elastically supported by a spring, the following performance feeling can be attained. When the slide manipulator is near the fulcrum, the feeling of bowing in the bow head position is given. As the slide manipulator is approached to the other end, the feeling of bowing in the bow middle position and finally in the bow base position is given. That is, when the slide manipulator is near the fulcrum, the influence on the action point is small though a large amount of force may be given. As the slide manipulator is approached to the other end, the influence on the action point becomes large though the same amount of force may be given.

Because the principle of the lever is utilized as described above, information pertaining to the bow position such as bow head or bow base can be outputted as musical tone performance information by natural motion of the hand without electrical control.

Figure 1A:
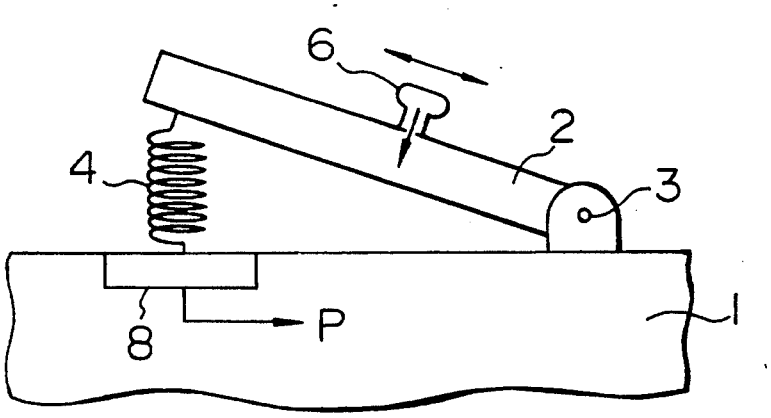
FIGS. 1A and 1B are schematic views showing two basic embodiments of the present invention.

In the drawing, the reference numerals designate the following parts: 1 supporting member; 2 turnable manipulator body; 3 rotation axis; 4 spring; 6 slide manipulator; 8 pressure sensor; 9 slide rheostat; 10 hole; 11 an upper-limit stopper (engaging projecting member); 12 window; 13 lower member; 14 lower member; 15 upper member; 16 linkage; 17 slide rheostat; 18 rotary rheostat; 19 pressure sensor; and 20 weight.

DESCRIPTION OF THE PREFERRED EMBODIMENTS

Figure 1B:
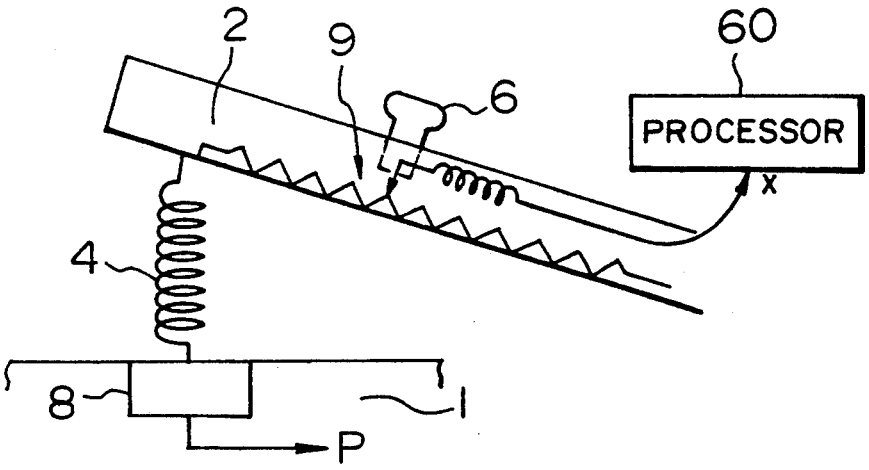

FIGS. 1A and 1B show basic embodiments of the present invention.

FIG. 1A is a schematic view of a manipulator for generating bow pressure data. A turnable manipulator body 2 is disposed on a surface of a fixed supporting member 1 so as to be turnably supported at its one end by a rotary axis 3. A spring 4 is connected between the other end of the manipulator body 2 and a pressure sensor 8 which is provided on the supporting member 1. Besides, a slide manipulator 6 is slidably disposed on the manipulator body 2. A performer holds the slide manipulator 6 by a hand and pushes down the slide manipulator 6 while shifting the position thereof to left and right in the drawing to thereby generate pressure information. When the slide manipulator 6 is near the rotary axis 3, large force is required for giving the same effect because the distance between the fulcrum and the force point is shorter than the distance between the fulcrum and the action point. On the other hand, when the slide manipulator 6 is moved to a neighborhood of the spring 4, the force required for giving the same effect to the spring 4 is small. That is, pressure data or bow pressure information similar to that in a natural musical instrument can be generated by manipulating the slide manipulator 6 in the same manner as at an end of a bow.

FIG. 1B shows a manipulator for generating bow pressure and bow position data as another basic embodiment of the invention. A slide rheostat 9 is disposed in the manipulator body 2. The slide manipulator 6 is connected to a slide terminal of the slide rheostat 9. A constant voltage is applied across the opposite ends of the slide rheostat so that the slide manipulator 6 detects a voltage at the position of the slide terminal. Except the aforementioned point, the structure of the manipulator of FIG. 1B is the same as that of FIG. 1A. Bow position data can be acquired by detecting information of position x from the slide manipulator 6. The position signal x is processed in a processor circuit 60 to generate a velocity signal as well as a position signal.

Bow velocity data can be generated by finding the change of the bow position data. When, for example, bow position data is generated on the basis of clock signals generated at regular time intervals, the change of the bow position data can be used directly as bow velocity data.

Figure 2:
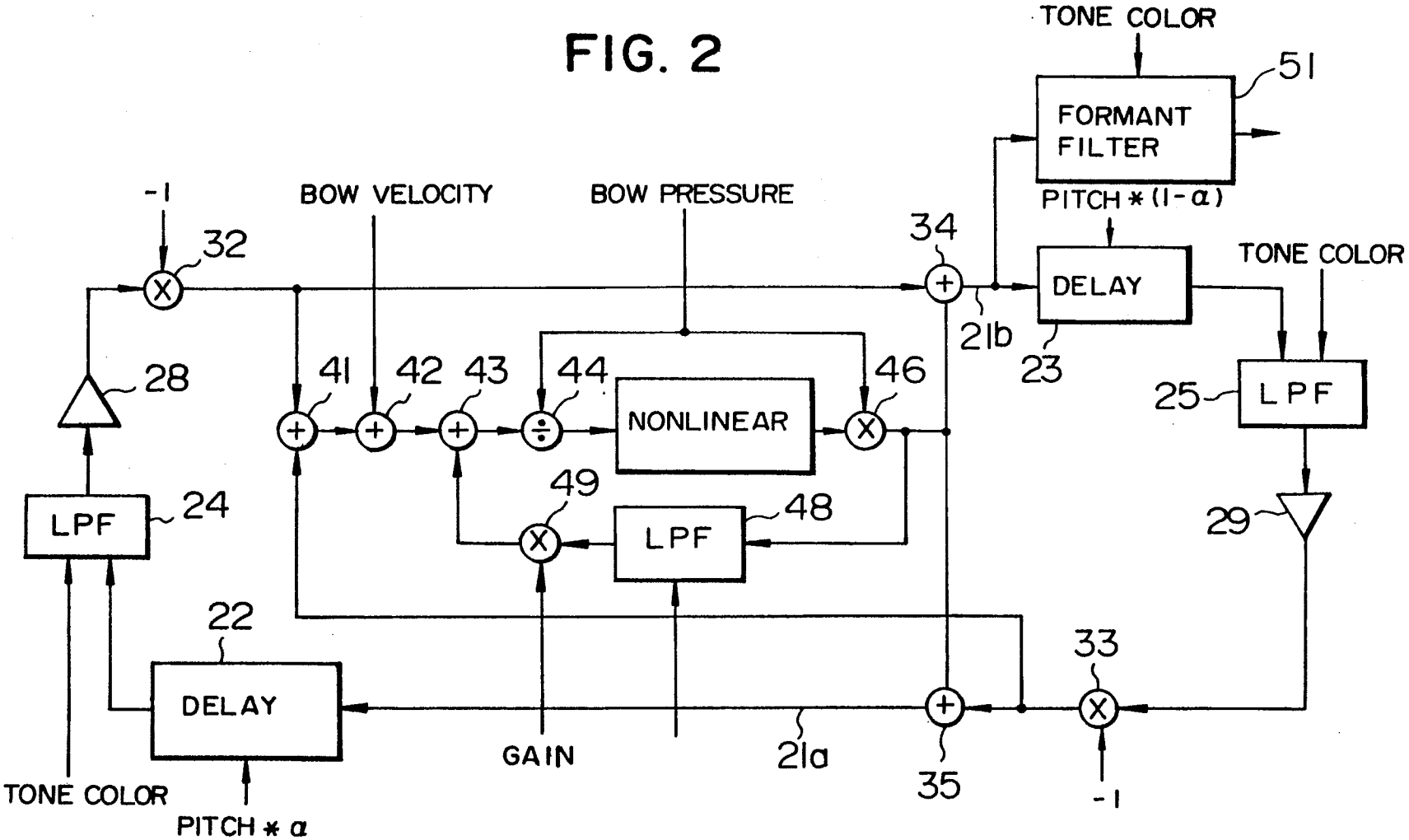
FIG. 2 is a circuit diagram showing an important portion of a musical tone signal generating circuit.

The bow pressure information or the bow pressure and bow velocity information thus generated may be used as a parameter in a musical tone signal generating circuit as shown in FIG. 2.

FIG. 2 is a schematic circuit diagram of a musical tone signal generating circuit for attaining a nonlinear musical tone synthesizing rubbed string model.

The bow velocity signal is inputted into an adder 42 to simulate the rubbing of a string of a rubbed string instrument with a bow. The bow velocity signal is a start signal and is supplied to a nonlinear circuit 45 through an adder 43 and a divider 44. The nonlinear circuit 45 is a circuit for expressing the nonlinear characteristic of a string of violin.

Figure 3A:
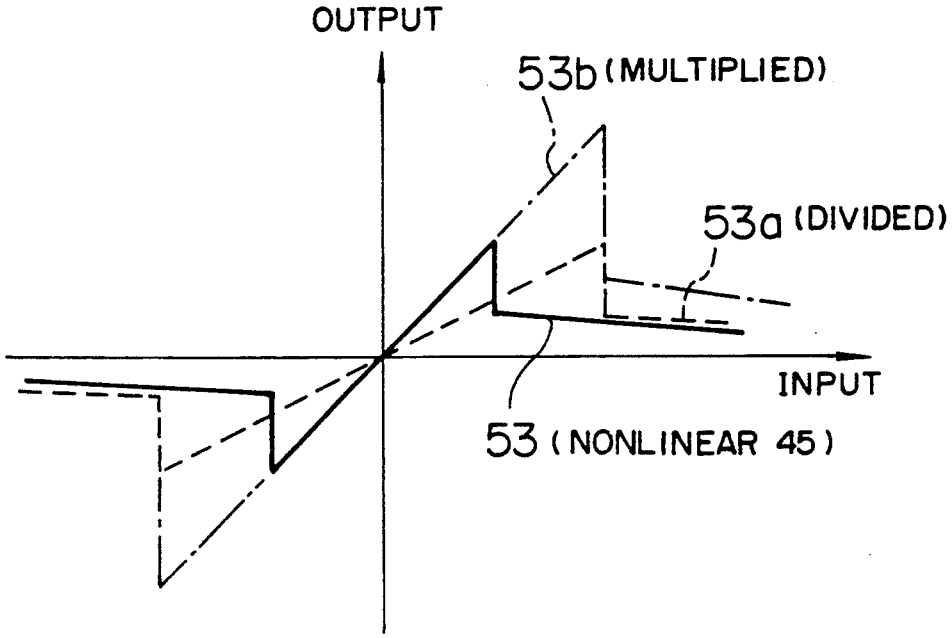
FIGS. 3A and 3B are graphs for explaining the characteristic of the nonlinear circuit.

The characteristic 53 of the nonlinear circuit 45 includes, as shown in FIG. 3A, a substantially linear characteristic region from the origin to certain points and the outer regions of changed characteristic. When a string of a rubbed string instrument such as a violin is rubbed with a bow, as long as the bow velocity is slow, the displacement of the string is almost equivalent to the displacement of the bow, and the movement of the string can be represented by the term of the static friction coefficient. This phenomenon is represented by the substantially linear characteristic region centering about the origin. When the relative velocity of the bow with respect to the string exceeds a certain value, the velocity of the bow and the displacement velocity of the string are no longer the same. That is, the dynamic friction coefficient determines the movement, in place of the static friction coefficient. This changeover from the static friction coefficient to the dynamic friction coefficient is represented by the step portion in FIG. 3A.

In FIG. 2, the output of the nonlinear circuit 45 is supplied to two adders 34 and 35 through a multiplier 46.

In response to the bow pressure signal, the divider 44 and the multiplier 46 which are provided respectively on the input and output sides of the nonlinear circuit 45 modify the characteristic of the nonlinear circuit 45. That is, the divider 44 on the input side divides the input signal to thereby change the value thereof into a smaller one. As shown by the broken line 53*a* of FIG. 3A, when there is provided the divider 44, even upon reception of a large input, the output of the nonlinear circuit 45 becomes as if the received input was small. The multiplier 46 on the output side plays the role of increasing the output of the nonlinear circuit 45. That is, the multiplier 46 increases the characteristic 53*a* produced by the divider 44 and the nonlinear circuit 45 to a larger value to thereby produce a characteristic 53*b* on the output side as shown by the dot-and-dash line of FIG. 3A. Here, under the same bow pressure signal, the fact that the input is first divided and then the output is multiplied means that a characteristic is divided by a coefficient C0 by means of the divider 44 and then the result is multiplied by the same coefficient C0 by means of the multiplier 46. In this case, the whole characteristic 53*b* as shown by the dot-and-dash line lies on the extension of the characteristic 53 which is produced solely by the nonlinear circuit 45, and has a shape which is provided by multiplying the characteristic 53 by C0 both in the directions of abscissa and ordinate. The coefficient of the multiplier may be changed so as to be different from the coefficient of the divider to thereby form a different shape. The adders 34 and 35 are provided in a circulating signal path 21 comprising two portions 21*a* and 21*b*. This circulating signal path 21 constitutes a closed loop for circulating the musical tone signal, corresponding to the string of the rubbed string instrument. This circulating signal path includes two delay circuits 22 and 23, two low-pass filters (LPFs) 24 and 25, two decay circuits 28 and 29, and two multipliers 32 and 33. Each of the delay circuits 22 and 23 receives the product of the pitch signal representing the pitch and a coefficient $\alpha$ or $(1-\alpha)$ and gives a predetermined delay time. The whole delay time required for a signal to circulate the circulating signal path 21 (21*a* and 21*b*) and return to the original position determines the whole basic pitch of the musical tone. That is, the sum of the respective delay times of the two delay circuits 22 and 23, pitch$\times[\alpha+(1-\alpha)]$=pitch, mainly determines the basic pitch. One delay circuit corresponds to the distance from the position where the bow touches the string to the bridge, and the other corresponds to the distance from the position where the bow touches the string to the position where a finger depresses the string.

Although the pitch is mainly determined by the delay circuits 22 and 23, delays are also produced by other factors included in the circulating signal path, such as LPFs 24 and 25, decay controls 28 and 29, etc. Strictly, the pitch of the musical tone signal to be generated is determined by the sum of all the delay times included in the loop.

The LPFs 24 and 25 simulate the vibration characteristics of various strings by modifying the transmission characteristic of the circulating waveform signal. A tone color signal is generated by selecting a tone color pad on the keyboard, etc. and supplied to the LPFs 24 and 25 to change over the characteristic to simulate the musical tone of the desired rubbed string instrument.

While propagating on the string, the vibration gradually decays. The decay controls 28 and 29 simulate the decay quantities of the vibration propagating on the string.

The multipliers 32 and 33 multiply the input by the reflection coefficient $-1$ in correspondence to the reflection of the vibration at a fixed end of the string. That is, assuming the reflection at the fixed end without any decay, the amplitude of the string is changed to the opposite phase. The coefficient $-1$ represents this opposite phase reflection. Decay of the amplitude at the reflection is incorporated in the decay quantities in the decay controls 28 and 29.

In this way, the motion of the string of the rubbed string instrument is simulated by the vibration circulating on the circulating signal path 21 (21*a* and 21*b*) which corresponds to the string.

Further, the motion of the string of the rubbed string instrument has hysteresis characteristic. To simulate the hysteresis characteristic, the output of the multiplier 46 is fed back to the input side of the nonlinear circuit 45 through the LPF 48 and the multiplier 49. The LPF 48 serves to prevent oscillation of the feedback loop.

Let now u be the input from the adder 42 to the adder 43, v be the input from the feedback path to the adder 43, and A be the amplification factor of the divider 44, the nonlinear circuit 45 and the multiplier 46 in total, then the output w of the multiplier 46 can be represented by $(u+v)A=w$. Let B be the gain of the negative feedback circuit including the LPF 48 and the multiplier 49, then the amount of feedback v can be represented by $v=wB$. Arranging these two equations, the following equation can be obtained.

$$(u+wB)A=w$$

$$\therefore w=uA/(1-AB)$$

In the case of no feedback, that is, $B=0$, the output w can be represented by $w=uA$, which means that a value formed by multiplying the input u simply by a factor A is outputted. In the case where negative feedback of a gain B is applied, an input being $1/(1-AB)$ times as large as that in the case of $B=0$ is required for attaining an output of the same magnitude.

Figure 3B:
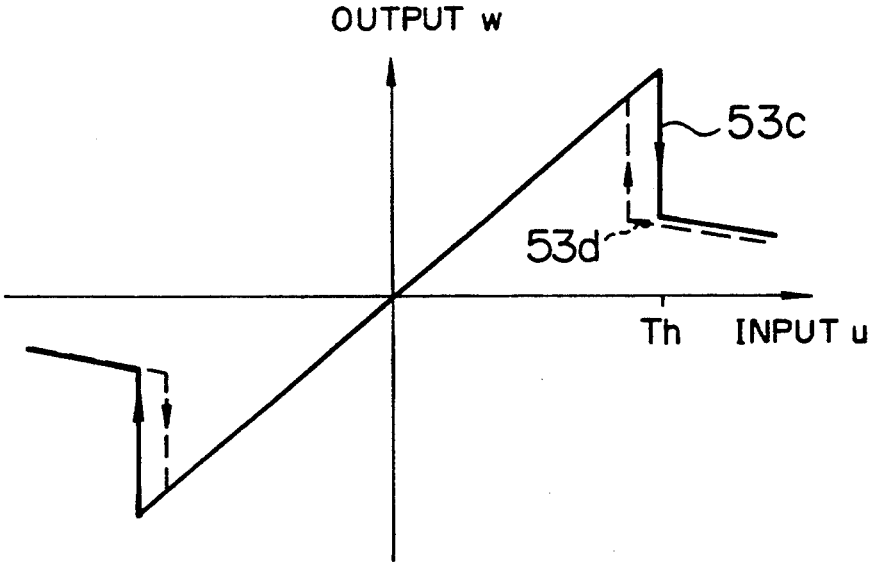

The characteristic when there is such feedback is represented by the characteristic curve 53*c* in FIG. 3B. When the input increases to a certain value, changeover from the static friction coefficient to the dynamic friction coefficient occurs and then the output decreases stepwise. Let now this threshold be Th.

In the case where the input has once exceeded the threshold Th and then decreases to a smaller value again, the output w is small and hence the feedback amount $v=Bw$ is also small. That is, even if the magnitude of the signal inputted into the nonlinear circuit 45 is constant, the negative feedback amount is small in the case of the dynamic friction coefficient region compared to the case of the static friction coefficient region and hence the input u from the adder 42 to the adder 43 becomes smaller.

Consider now the magnitude of the input u from the adder 42 when the input to the nonlinear circuit 45 reaches the threshold. When the input is increasing, the static friction coefficient dominates the motion, a strong negative feedback is applied correspondingly to a large output, and hence the changeover occurs at a larger input Th. When the input is decreasing, the dynamic friction coefficient dominates the motion, the negative feedback amount is small correspondingly to a small output, and hence the changeover occurs at a smaller input value u. Accordingly, by examining the relation between the input u and the output w when the input is gradually increasing and when the input is gradually decreasing, such a hysteresis characteristic as shown by the characteristic curves 53*c* and 53*d* in FIG. 3B can be obtained. The magnitude of the hysteresis is controlled by the gain of the multiplier 49.

In this way, according to the musical tone signal generating circuit shown in FIG. 2, the motion of the string of a rubbed string instrument can be simulated and a basic waveform of the musical tone signal can be produced.

An output is derived from some point in the circulating signal path 21 (21*a* and 21*b*) as shown in FIG. 2 and is supplied to a sound system through a formant filter 51 which simulates the characteristic of the belly of a rubbed string instrument. It can be also arranged that the formant filter receives a tone color signal and modifies the characteristic.

In the musical tone signal generating circuit shown in FIG. 2, a signal serving as motive power for generating a musical tone is given by the bow velocity. Further, the bow pressure is used as a signal for controlling the characteristic of the nonlinear circuit 45. That is, the bow velocity and bow pressure are necessary as basic parameters for simulating the musical tone of a rubbed string instrument. A parameter for designating the pitch can be derived by manipulating a key in the keyboard, but bow velocity information and bow pressure information cannot be freely obtained from the keyboard (though such information can be calculated suitably on the basis of touch). It is preferable that these parameters, especially the bow pressure, are controllable on the basis of the performer's will or the performance manipulation. Bow pressure data or bow pressure and bow velocity data can be generated with a natural feeling similar to the feeling of bowing in a natural musical instrument, by using the manipulator as shown in FIGS. 1A and 1B.

Figure 4:
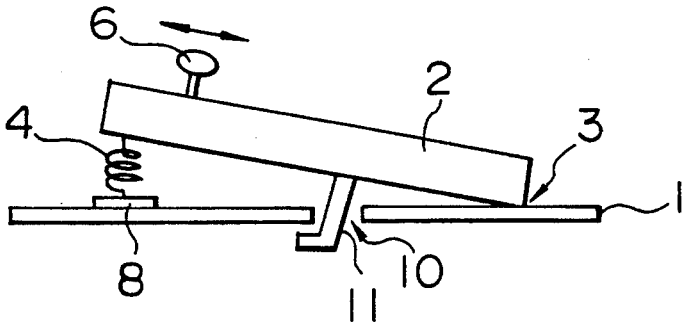
FIGS. 4, 5 and 6 are views for illustrating upper-limit stopper-including manipulators as embodiments of the invention.

FIG. 4 shows a performance manipulator as a further embodiment of the invention. A manipulator body 2 is connected at its one end to a supporting member 1 in the form of a hinge 3. A hole 10 is formed in the supporting member 1. An upper-limit stopper 11 extending down from the manipulator body 2 passes through the hole 10 and engages with the rear side of the supporting member 1 to determine an upper limit for the manipulator body 2. A spring 4 is connected to the other end of the manipulator body 2. A pressure sensor 8 is provided at the other or lower end of the spring 4. Further, a slide manipulator 6 is connected to the slide terminal of a slide rheostat, so that the position of the slide manipulator 6 can be found from an output voltage. When the slide manipulator 6 is near the fulcrum 3, large force is required for pressing the spring 4. When the slide manipulator 6 is moved to a neighborhood of the spring 4, however, the spring 4 can be pressed by smaller force. The manipulation of the slide manipulator by utilizing the principle of the lever is similar to bowing (manipulation of the bow) in a rubbed string instrument. While the signal obtained from the slide terminal of the slide manipulator 6 represents the position of the slide manipulator, a bow velocity signal can be also formed by detecting the change of the position thereof.

Further, to beginners in particular, a mode can be set so that the position of the slide manipulator 6 itself represents the bow velocity.

Figure 5:
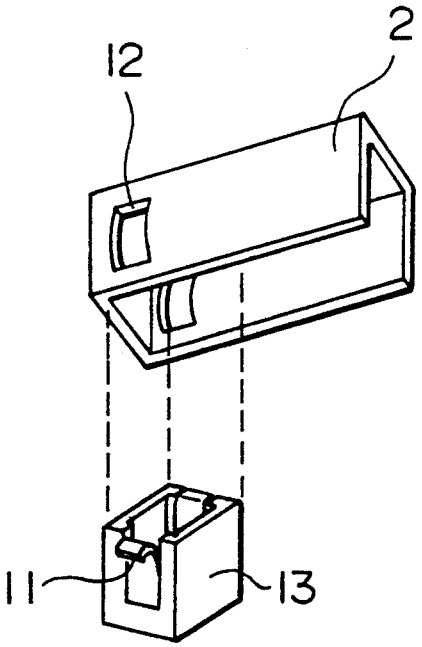

FIG. 5 is a perspective view showing another structure of the upper-limit stopper. One shown in the upper portion in the drawing is a manipulator body which is hollow and provided with windows 12 slightly arched at sides thereof. A lower member 13 of the upper-limit stopper is fixed to the supporting member 1. Engagement projecting members 11 having elasticity are provided at sides of the lower member 13.

When the engagement projecting members 11 of the lower member 13 are respectively inserted into the windows 12 while the manipulator body is pushed down, the range in which the manipulator body 2 can move is limited by the upper and lower ends of the respective window 12. Accordingly, the upper and lower limits of the manipulator body 2 are determined.

Figure 6:
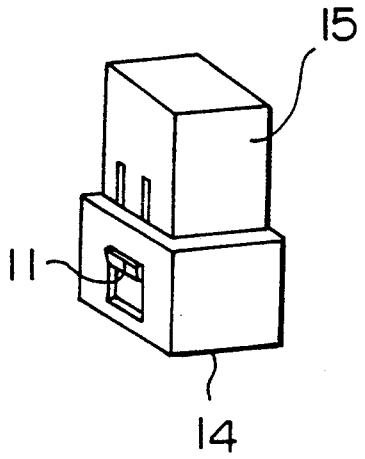

FIG. 6 shows a further example of the upper-limit stopper. Although FIG. 5 shows the case where a manipulator body provided with windows and a lower member 13 including engagement projecting members 11 are used, FIG. 6 (this embodiment) shows the case where engagement members 11 are formed in an upper member 15 to be connected to a manipulator body 2 and windows are formed in a lower member 14 to be fixed to a supporting member 1.

When one of the structures shown in FIGS. 5 and 6 is employed, there is no necessity of providing a hole in the supporting member 1.

Although the embodiment of FIG. 4 shows the case where bow pressure information is obtained by the pressure sensor 8 disposed under the spring 4, the invention can be applied to the case where pressure information may be obtained by other means.

Figure 7:
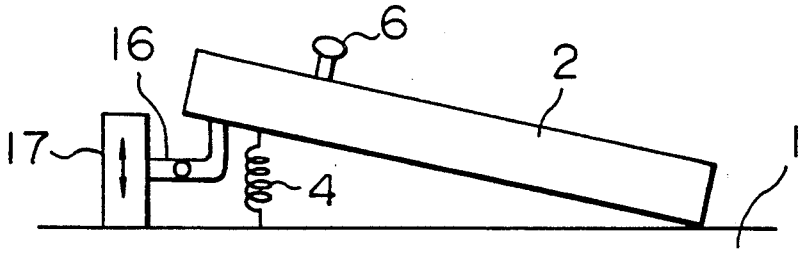
FIGS. 7, 8 and 9 are schematic views for illustrating the structures of manipulators as other embodiments of the invention.

FIG. 7 shows a manipulator as a further embodiment of the invention. This embodiment is similar to the aforementioned embodiment of FIG. 4 in that a manipulator body 2 provided with a slide manipulator 6 is disposed on a supporting member 1 and a spring 4 is suspended between the manipulator body 2 and the supporting member 1. In this embodiment, a linkage 16 is connected at its one end to a movable end of the manipulator body 2. The other end of the linkage 16 is connected to a slide rheostat 17 having a narrow slide range. The manipulator body 2 is normally urged upward by the spring 4, but when the performer holds the slide manipulator 6 and pushes it down, the linkage 16 is urged to rotate so that the slide terminal of the slide rheostat 17 slides. As a result, a bow pressure signal can be produced by a signal obtained from the slide rheostat 17.

Figure 8:
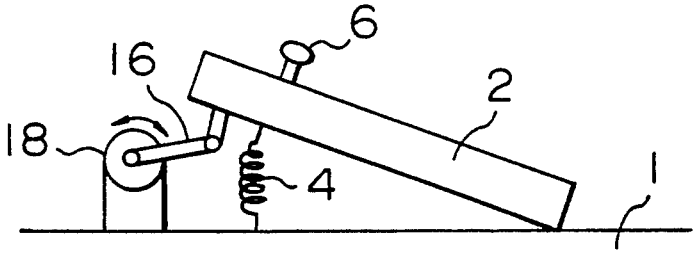

FIG. 8 shows a manipulator as a further embodiment of the invention. This embodiment is similar to the aforementioned embodiment in that a manipulator body 2 is disposed on a supporting member 1 and a slide manipulator 6 and a spring 4 are connected to the manipulator body 2. One end of a linkage **16*a* is connected to the upper end of the manipulator body 2 in a similar manner as in the embodiment of FIG. 7. The linkage 16*a* includes hinged tow arms. The other end of the l linkage 16*a* is connected to a rotary rheostat 18**.

When the performer holds the slide terminal 6 and pushes it down, the lower arm of the linkage **16*a* rotates around an axis to change the angle of the slide terminal of the rotary rheostat 18**. A bow pressure signal can be produced by deriving this change as a signal.

Figure 9:
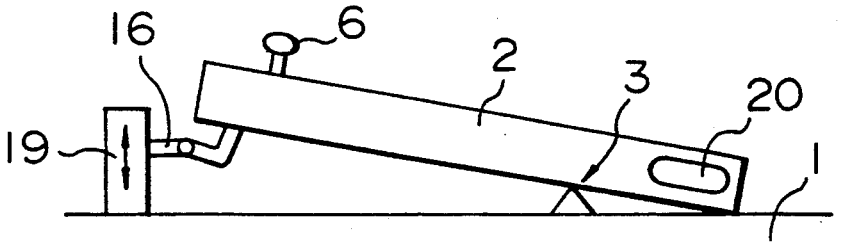

FIG. 9 shows a manipulator as a further embodiment of the invention. In this embodiment, the manipulator body 2 is supported at a fulcrum 3 on the supporting member 1. A weight 20 is incorporated in a portion at the right of the fulcrum 3 in the drawing, so that the right side of the manipulator body is sunk by the weight 20 when the manipulator body 2 is left as it is. In this embodiment, no spring is used for biasing the manipulator body 2. The weight 20 is used instead of the spring. A linkage 16 is connected to the left end of the manipulator body 2. The linkage 16 is rotatable around an axis. The action end of the linkage 16 is connected to a pressure sensor 19 such as a load cell. That is, when the performer holds the slide terminal 6 so as to press down the manipulator body 2, the pressure sensor 19 detects the pressure. When the performer weakens the downward pressing force, the manipulator body 2 is restored to a state where the left side is higher than the right side, by the gravity of the weight 20.

In the aforementioned embodiments, the manipulator body is supported by utilizing the principle of the lever, so that the force required for producing a bow pressure in the case of manipulation at a position far from the fulcrum is different from the force required for producing the same bow pressure in the case of manipulation at a position near the fulcrum. In short, the performance manipulation has the same feeling as that of genuine bowing. In the case of manipulation at a position far from the fulcrum, the manipulation corresponds to bow base execution. In the case of manipulation at a position near the fulcrum, the manipulation corresponds to bow head execution.

Although the pressure sensor can be constituted by a combination of a rheostat and an elastic material such as a spring, a weight or the like may be used instead of the elastic member.

Although bow velocity information can be obtained by detecting the position of the slide manipulator and then differentiating it, it may be also arranged that the bow velocity is directly correlated with the position of the slide manipulator. Further, it may be arranged that these two mode can be used selectively.

As described above, according to the embodiments of the present invention, a manipulator utilizing the principle of the lever is provided, so that the force required for producing the same effect varies according to the position of the manipulator. The phenomenon that the force required for producing the same output varies according to the position of the manipulator is similar to bowing in a rubbed string instrument, so that performance manipulation becomes natural.

Although description has been made along the preferred embodiments of this invention, the scope of the invention is not limited thereto. For example, it will be apparent for those skilled in the art that various alterations, substitutions, improvements and combinations thereof are possible.

What is claimed is:

1. A musical tone control information input manipulator for an electronic musical instrument, comprising:

a supporting member;

a manipulator body attached to said supporting member so as to be turnable relative to said supporting member;

a restoring member for generating force to drive said manipulator body to a predetermined stable position;

a slide manipulator attached on said manipulator body so as to be slidable relative to said manipulator body; and pressure sensing means for detecting an amount of pressure transmitted to the manipulator body by a performer through said slide manipulator.

2. A musical tone control information input manipulator for an electronic musical instrument according to claim 1, further comprising a sensor attached to said manipulator body and engaged with said slide manipulator for detecting the position of said slide manipulator.

3. A musical tone control information input manipulator for an electronic musical instrument according to claim 1, further comprising a sensor attached to said manipulator body and engaged with said slide manipulator for detecting a velocity of performance manipulation of said slide manipulator.

4. A musical tone control information input manipulator for an electronic musical instrument according to claim 1, in which said manipulator body is supported on said supporting member in the form of a lever having a fulcrum, a force point and an action point, said fulcrum being provided at a first end portion of said manipulator body, said force point being provided at said slide manipulator body.

5. A musical tone control information input manipulator for an electronic musical instrument according to claim 4, in which said restoring member is a spring means connected to said manipulator body at said action point.

6. A musical tone control information input manipulator for an electronic musical instrument according to claim 5, in which said pressure sensing means is connected to said manipulator body through said spring means.

7. A musical tone control information input manipulator for an electronic musical instrument according to claim 4, in which said pressure sensing means is a slide rheostat with a slide terminal, further comprising a linkage for linking said slide terminal with a second end portion of said manipulator body.

8. A musical tone control information input manipulator for an electronic musical instrument according to claim 4, in which said pressure sensing means is a rotary rheostat with a slide terminal, further comprising a linkage for linking said slide terminal with a second end portion of said manipulator body.

9. A musical tone control information input manipulator for an electronic musical instrument according to claim 4, in which said pressure sensing means is a pressure sensing element, further comprising a linkage for coupling a second end portion of said manipulator body with said pressure sensing element.

10. A musical tone control information input manipulator for an electronic musical instrument according to claim 1, in which said manipulator body has a first and second end portions and is supported on said supporting member in the form of a lever having a fulcrum, a force point and an action point, said force point being provided at said slide manipulator, said action point being provided at the second end portion of said manipulator body, said fulcrum being provided at a position of said manipulator body between the first and the second end portions thereof.

11. A musical tone control information input manipulator for an electronic musical instrument according to claim 10, in which said restoring member is a weight provided on said manipulator body at said first end portion of the manipulator body.

12. A musical tone control information input manipulator for an electronic musical instrument according to claim 11, in which said pressure sensing means is a slide rheostat with a slide terminal, further comprising a linkage for linking said slide terminal with said second end portion of said manipulator body through a linkage.

13. An electronic musical instrument, comprising:

a supporting member;

a manipulator body attached to said supporting member so as to be turnable relative to said supporting member;

a restoring member for generating force to drive said manipulator body to a predetermined stable position;

a slide manipulator attached on said manipulator body so as to be slidable relative to said manipulator body to provide a tone controlling signal;

pressure sensing means for detecting pressure transmitted by a performer through said slide manipulator and generating a pressure signal; and tone signal generation means for generating a tone signal, wherein said tone signal generation means includes closed-loop means for circulating a signal input thereto, said closed-loop means having at least one delay unit, and excitation means for generating an excitation signal which is based on said tone controlling signal and said pressure signal and which is input to said closed-loop means, wherein said tone signal is output from said closed-loop means.

* * * * *